US007644829B2

(12) United States Patent
Little et al.

(10) Patent No.: US 7,644,829 B2
(45) **Date of Patent: *Jan. 12, 2010**

(54) PLASTIC CONTAINER INCLUDING A GRIP FEATURE

(75) Inventors: J. Steven Little, Wadsworth, OH (US); James J. Miller, Barberton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 171 days.

This patent is subject to a terminal disclaimer.

(21) Appl. No.: 11/642,336

(22) Filed: Dec. 20, 2006

(65) Prior Publication Data

US 2008/0093332 A1 Apr. 24, 2008

Related U.S. Application Data

(63) Continuation-in-part of application No. 29/264,265, filed on Aug. 7, 2006, now Pat. No. Des. 543,862.

(51) Int. Cl.
*B65D 23/10* (2006.01)

(52) U.S. Cl. ..... 215/384; 215/398; 220/771

(58) Field of Classification Search ..... 215/383.384, 215/398; 220/770, 771; 222/572
See application file for complete search history.

(56) References Cited

U.S. PATENT DOCUMENTS

| | | | | | |
|---|---|---|---|---|---|
| 1,599,967 | A | * | 9/1926 | Johnson | 222/465.1 |
| D198,407 | S | * | 6/1964 | Busch | D9/543 |
| 3,194,423 | A | * | 7/1965 | Mailoff | 215/383 |
| 3,232,495 | A | * | 2/1966 | Schueider | 222/209 |
| 5,103,988 | A | * | 4/1992 | Reil et al. | 215/384 |
| 5,224,614 | A | * | 7/1993 | Bono et al. | 215/384 |
| D370,850 | S | * | 6/1996 | Beaver | D9/543 |
| D378,058 | S | * | 2/1997 | Meisner et al. | D9/523 |
| D393,211 | S | * | 4/1998 | Mengeu | D9/543 |
| 6,059,153 | A | * | 5/2000 | Olson et al. | 222/465.1 |
| D431,470 | S | * | 10/2000 | Henderson | D9/520 |
| 6,164,474 | A | * | 12/2000 | Cheng et al. | 215/384 |
| 6,210,032 | B1 | * | 4/2001 | Murphy | 366/147 |
| 6,889,866 | B2 | * | 5/2005 | Gilliam et al. | 220/675 |
| D528,007 | S | * | 9/2006 | De Niverville et al. | D9/543 |
| 2004/0099109 | A1 | * | 5/2004 | Dunlap et al. | 83/48 |
| 2005/0023293 | A1 | * | 2/2005 | Kasting et al. | 222/111 |
| 2006/0156811 | A1 | * | 7/2006 | Borowski et al. | 73/426 |

* cited by examiner

*Primary Examiner*—Sue A Weaver
(74) *Attorney, Agent, or Firm*—Dykema Gossett PLLC

(57) ABSTRACT

A blow molded, hollow plastic container including two opposed, relatively longer sidewall and shoulder portions which alternate with two opposed, relatively shorter sidewall and shoulder portions. A first of the relatively shorter sidewall portions includes a grip area in the upper portion of the first relatively shorter sidewall portion, and the opposed second relatively shorter sidewall and shoulder portions includes a pour area.

13 Claims, 4 Drawing Sheets

PLASTIC CONTAINER INCLUDING A GRIP FEATURE

CROSS-REFERENCE TO RELATED APPLICATIONS

This application is a continuation-in-part of U.S. patent application Ser. No. 29/264,265, filed Aug. 7, 2006 now U.S. Pat. No. Design,543,862.

BACKGROUND OF THE INVENTION

Plastic containers are widely used commercially for a variety of products. It is highly desirable to provide a plastic container which facilitates ease of product dispensing, while at the same time providing a container with an improved configuration which enables more convenient handling in the product preparation and filling cycles and by the consumer in use. Ease of container handling and product dispensing is particularly desirable. It would also be advantageous to provide a light weight container which would enable rapid cycle times in the container preparation and filling procedure while facilitating product use, especially product dispensing from the container.

It is, therefore, an object of the present invention to provide an improved plastic container which facilitates container handling and product dispensing and which enables ease of use by the consumer.

It is a further object of the present invention to provide an improved plastic container as aforesaid with an improved container configuration which enables convenient handling in the product preparation and filling cycles and by the consumer in use.

Further objects of the present invention will appear hereinbelow.

SUMMARY OF THE PRESENT INVENTION

In accordance with the present invention the foregoing objects and advantages are readily obtained.

The improved plastic container of the present invention comprises: a blow molded, hollow plastic container having a generally oval base, a cylindrical sidewall extending upwardly from the base, a shoulder portion extending upwardly and inwardly from the sidewall and a neck finish extending upwardly from the shoulder portion and having a generally oval opening to the inside of the container; wherein said container includes two opposed, relatively longer sidewall and shoulder portions which alternate with two opposed, relatively shorter sidewall and shoulder portions; and with a first of said relatively shorter sidewall and shoulder portions being relatively longer than a second of said relatively shorter sidewall and shoulder portions, and with said first relatively shorter sidewall portions including an integral grip area thereon, as a hand or finger grip area, in the upper portion of said first relatively shorter sidewall portion adjacent said shoulder portion, and wherein the surface area of the opening is smaller than the surface area of the base with the ratio of opening to base being from 1:1.4-1.5.

Preferably, the grip area is inwardly curved towards the opening and includes at least two external ribs spaced from each other to facilitate handling, desirably a plurality of said ribs. The ribs desirably at least in part extend circumferentially around the grip area onto the adjacent relatively longer sidewall portions.

Preferably also the grip and shoulder area are inwardly curved towards the opening to facilitate handling and pouring.

The hand or finger grip area desirably includes a curved external grip area and a recessed or indented portion beneath the grip area. The recessed portion is desirably at least 0.500 inch below the outer extent of the curved external grip area. Two of said recessed portions are provided, one of which on each of the adjacent longer sidewall portion. The relatively deep indentation provides for ease of handling.

While the plastic container can be readily used with any plastic material, it is particularly suitable for use with polyethylene terephthalate.

Further features and advantages of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

Figure 2:
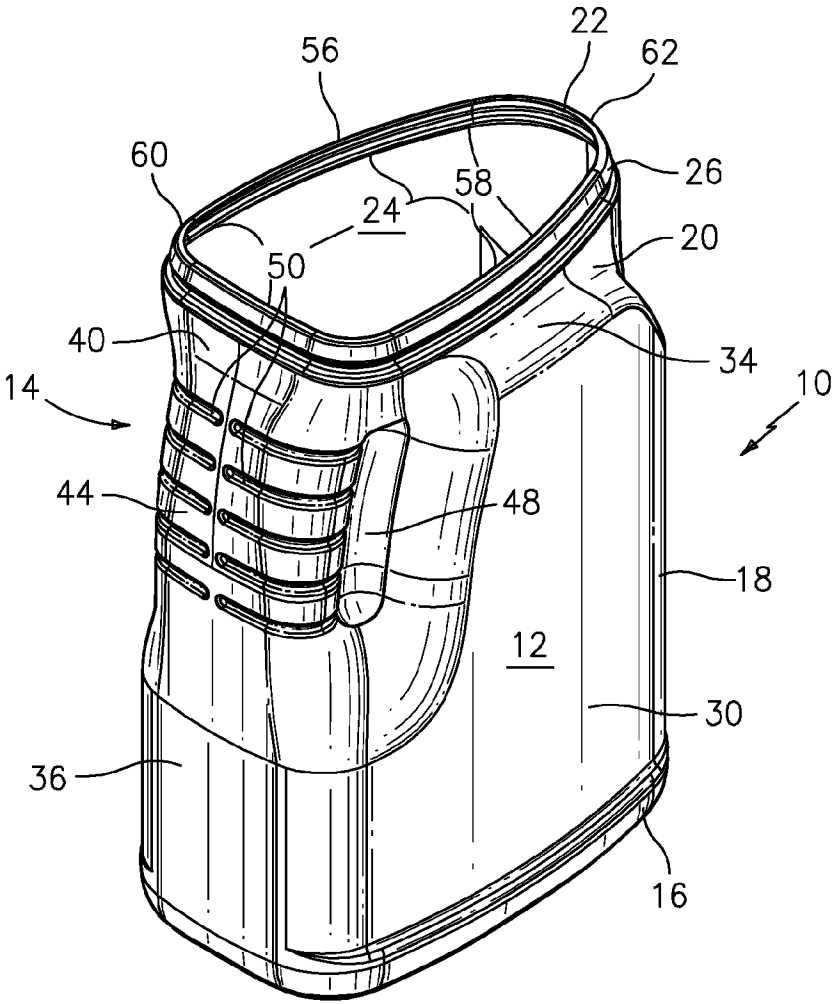
FIG. 2 is a perspective view thereof showing the rear and right side.
Figure 1:
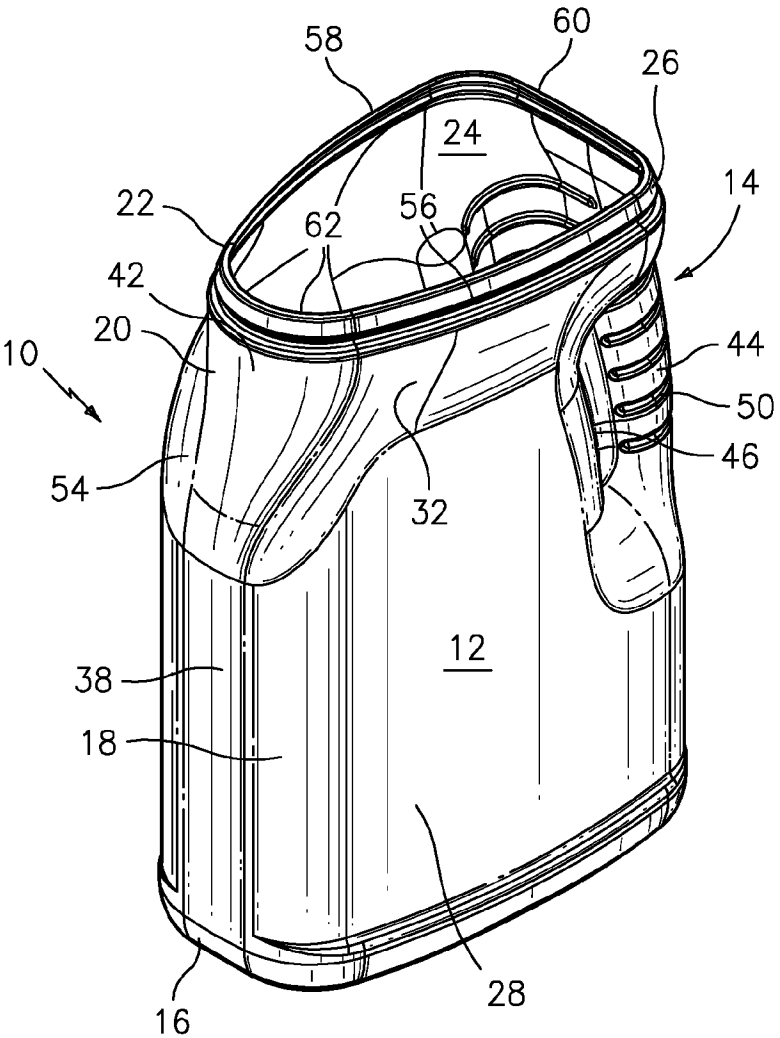
FIG. 1 is a perspective view of one embodiment of the plastic container of the present invention showing the front and left side thereof.
Figure 4:
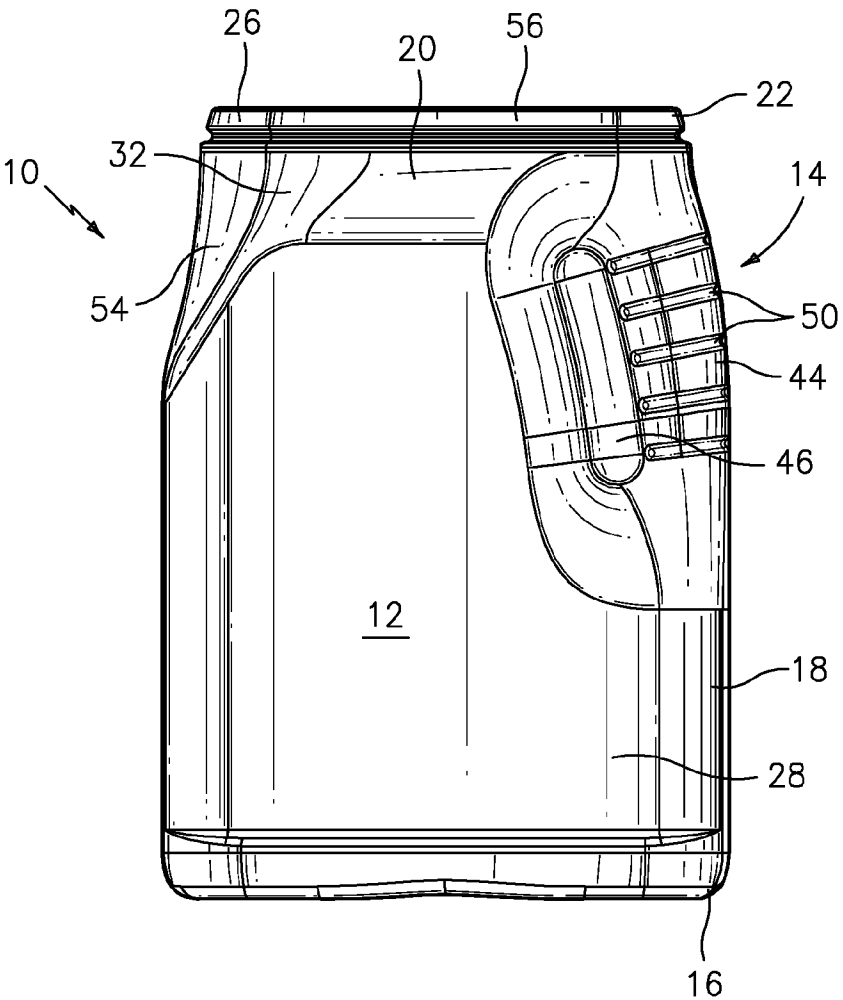
FIG. 4 is a side elevation view thereof showing the left side.
Figure 3:
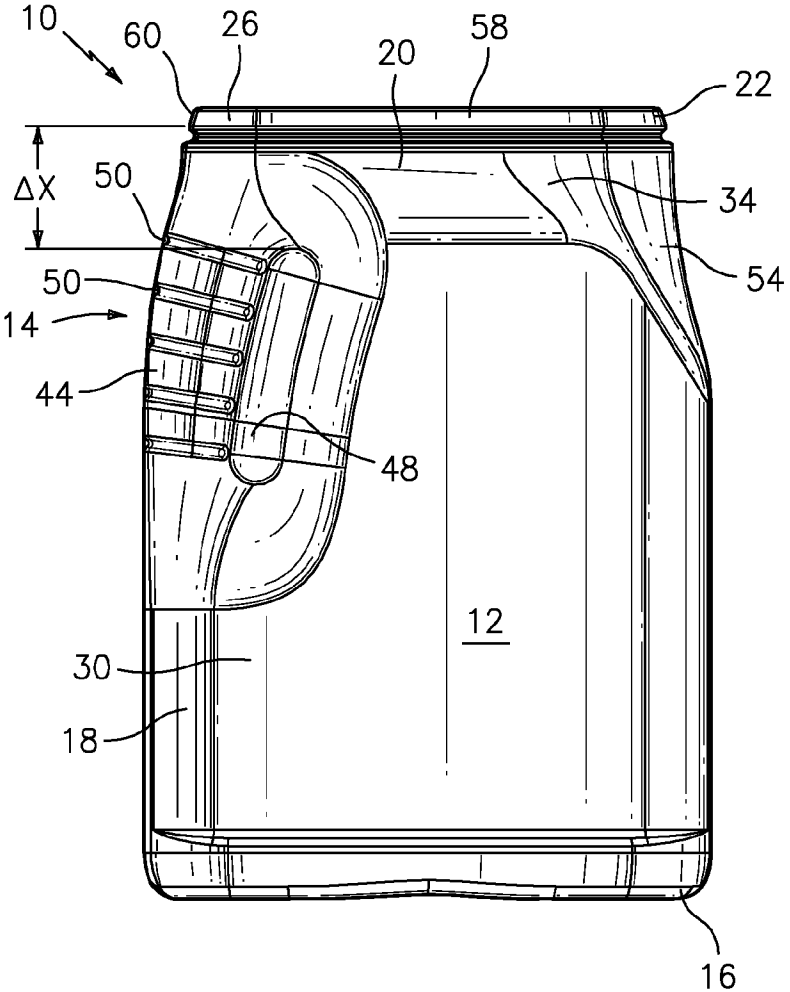
FIG. 3 is a side elevation view thereof showing the right side.
Figure 5:
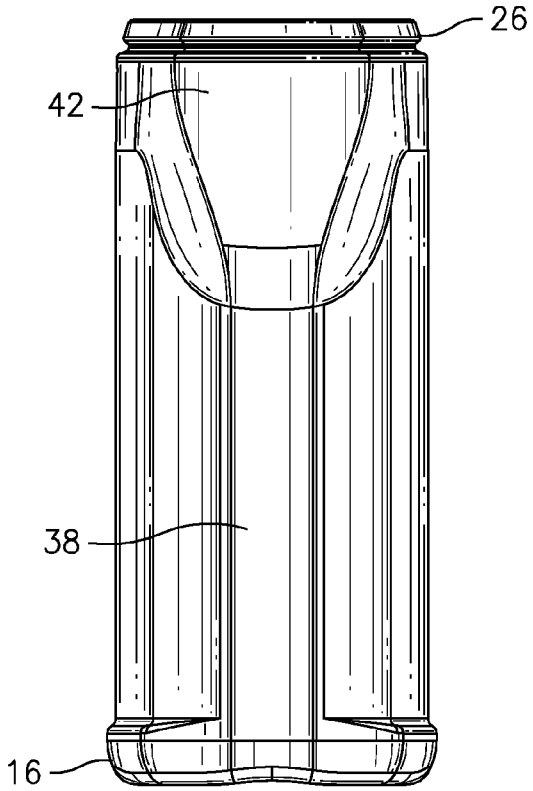
FIG. 5 is a side elevation view thereof showing the front.
Figure 6:
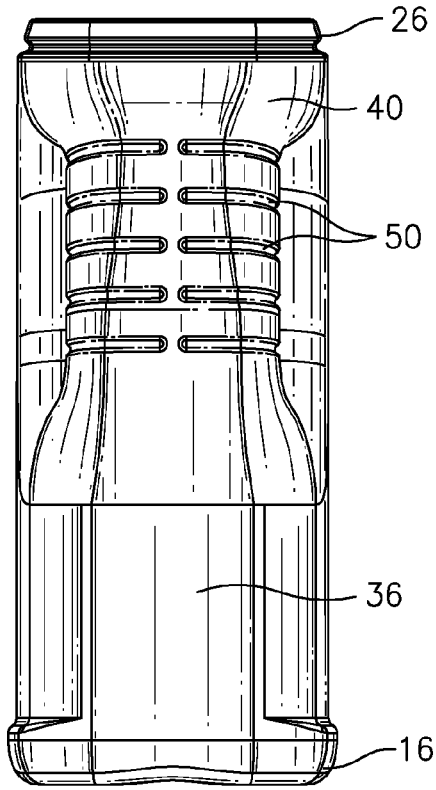
FIG. 6 is a side elevation view thereof showing the rear.
Figure 7:
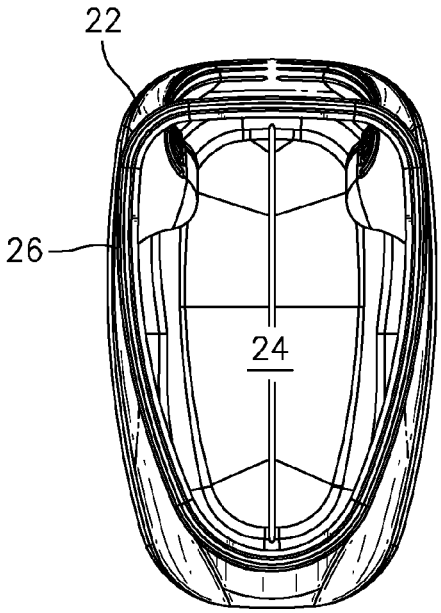
FIG. 7 is a top plan view thereof.
Figure 8:
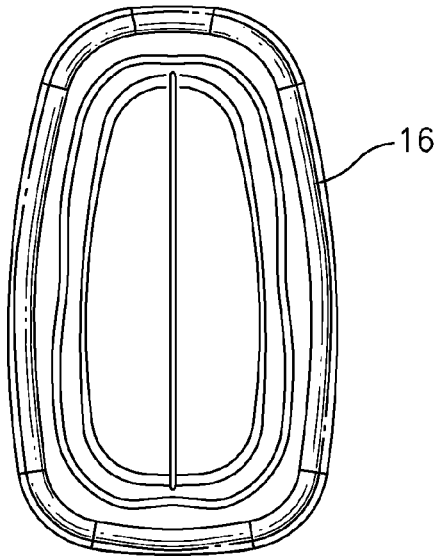
FIG. 8 is a bottom plan view thereof.
Figure 9:
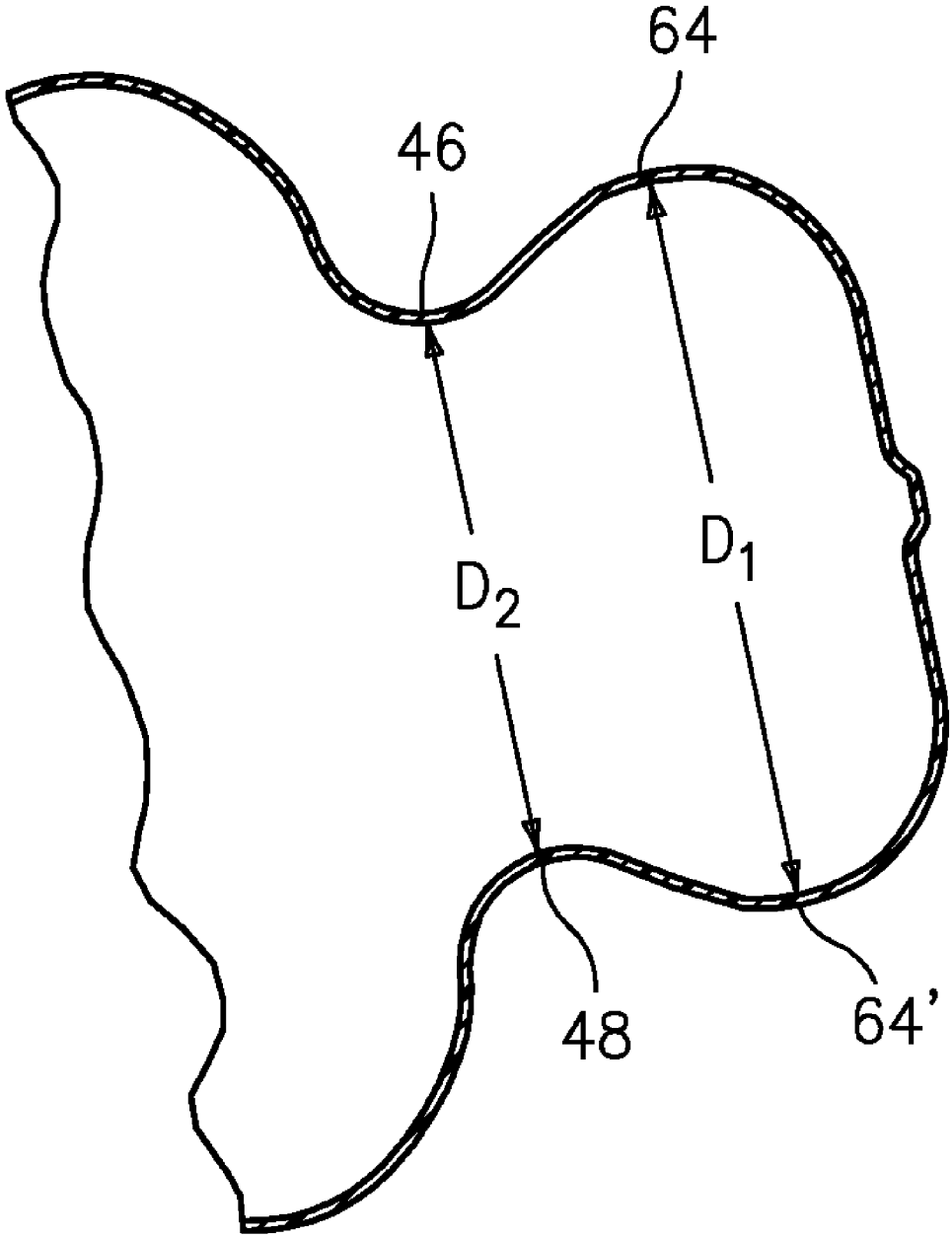
FIG. 9 is a sectional view thereof showing the handle portion.

Referring to the drawings, FIGS. 1-9 show one embodiment of the plastic container of the present invention.

FIGS. 1-4 shows plastic container 10 of the present invention with container portion 12 and integral grip area 14. The container is a hollow, blow molded plastic container having a lower supporting base 16, a sidewall 18 extending upwardly from the base, a shoulder portion 20 extending upwardly from the sidewall, and a neck finish 22 extending upwardly from the sidewall and having an opening 24 to the inside of the container. The plastic container 10 has a generally oval base 16, see FIG. 8, and a generally oval opening 24 to the inside of the container, see FIG. 7.

The containers of the present invention are preferably made of a pliable, deformable, synthetic plastic material, such as for example, polyethylene, polypropylene, or polyethylene terephthalate (PET), or other plastic material, although PET is generally used.

The particular neck portion 22 shown in the drawings includes an upper flange portion 26 for a snap-on closure and/or a foil closure (not shown). However, other type neck finishes can be readily employed, as a threaded section to accommodate a screw-on closure. Also, the outer extent of the upper neck finish in the embodiment shown extends inwardly of the sidewall.

Plastic container 10 includes two, opposed first and second relatively larger sidewall portions 28, 30, respectively, and two opposed first and second relatively larger shoulder portions, 32, 34, respectively, which alternate with two opposed, first and second relatively shorter sidewall portions 36, 38, respectively, and two opposed relatively shorter shoulder portions 40, 42, respectively. The first relatively shorter sidewall portion 36 is relatively longer than the second of said relatively shorter sidewall portion 38. In addition, grip portion 44 is included on the first relatively shorter sidewall portion 36. The grip portion 44 is a hand or finger grip area which includes first and second spaced apart recessed portions 46 and 48, respectively, each of which is adjacent the grip area on the adjacent relatively longer sidewall portions. That is, first recessed area 46 is on the first relatively longer sidewall portion 28 and second recessed area 48 is on the second relatively longer sidewall portion 30. Thus, a convenient hand or finger grip area is provided which facilitates a strong and firm hold onto the container by the user.

As can be clearly seen from the drawings, the shoulder portions 20 extend upwardly and inwardly from the sidewall 18 to the neck finish 22. In addition, the integral grip area 14 is in the upper portion of the first relatively shorter sidewall portion 36 adjacent the shoulder portion. Moreover, the grip portion 14 and shoulder portion 20 are inwardly curved towards the opening 24 and the grip portion 44 preferably includes external ribs 50 spaced from each other to facilitate handling. At least two of these ribs are provided and preferably a plurality of the ribs are provided. In the embodiment shown in the drawings five spaced apart ribs are shown. The ribs desirably extend circumferentially around the grip area onto the adjacent relatively longer sidewall portions 28, 30.

The grip area 14 includes the curved external grip portion 44 and the recessed areas 46, 48. The recessed portions are each located on an adjacent longer sidewall portion, i.e., first recessed area 46 is located on first longer sidewall 28 and second recessed area is located on second longer sidewall 30. In addition, the second relatively shorter sidewall portion 38 and second shorter shoulder portion 42 include an inwardly curved, recessed pour area 54 beneath opening 24, which facilitates the dispensing operation.

Similarly, the neck finish area 22 includes two, opposed first and second relatively longer neck finish portions 56, 58, respectively, which extend upwardly from the first and second longer shoulder portions 32, 34, respectively, and two opposed first and second relatively shorter neck finish portions 60,62 respectively, which extend upwardly from the shorter shoulder portions 40, 42, respectively. The first relatively shorter neck finish portion 60 is relatively longer than the second relatively shorter neck finish portion 62 to provide a convenient dispensing or pour channel at the shorter neck finish portion 62. The dispensing function is enhanced by the recessed dispensing or pour area 54 beneath the second shorter neck finish portion 62 on the second shorter shoulder portion 42. The dispensing function is further enhanced by providing that the circumference of the neck finish opening 24 is smaller than the circumference of the base 16. In addition, the corners of the second shorter neck finish side portions have a round circumference to further facilitate dispensing.

Therefore, in accordance with the present invention the surface area of the opening 24 is smaller than the surface area of the base 16, with the ratio of the circumference of the opening 24 to the base circumference being 1:1.4 to 1:2.5. In addition, the recessed portion 46, 48 beneath the grip area or handle 14 is at least 0.500 inch ($\Delta x$) below the neck finish portion 60 of the curved external grip portion 44. This facilitates handling and simplified dispensing. In the embodiment shown in FIG. 9, the outer extent of the grip portion (distance $D_1$) is 2.875 inches or 73.03 mm., and the outer extent of the recessed portion (distance $D_2$) is 2.100 inches or 53.34 mm.

Thus, it can be seen that the plastic container of the present invention is extremely convenient for handling and dispensing contents. The upper grip area is opposed to the dispensing area and is convenient to use, and the sidewall, shoulder and neck finish features make the container quite easy to use. An additional advantage of the present container is that the container is readily stackable.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container which comprises:

a blow molded plastic container having a generally oval base, a cylindrical sidewall extending upwardly from the base, a shoulder portion extending upwardly and inwardly from the sidewall and a neck finish extending upwardly from the shoulder portion and having a generally oval opening to the inside of the container;

wherein said container includes two opposed, relatively longer sidewall and shoulder portions which alternate with two opposed, relatively shorter sidewall and shoulder portions; and with a first of said relatively shorter sidewall and shoulder portions being relatively longer than a second of said relatively shorter sidewall and shoulder portions, and with said first relatively shorter sidewall portion including an integral grip area in the upper portion of said first relatively shorter sidewall portion adjacent said shoulder portion, and wherein the surface area of the opening is smaller than the surface area of the base;

wherein said grip area is a hand or finger grip area, and said hand or finger grip area includes an external grip portion extending onto the relatively longer sidewall portions and a recessed portion adjacent the grip portion and on the relatively longer sidewall portions.

2. A plastic container according to claim 1, wherein said grip portion is inwardly curved towards said opening.

3. A plastic container according to claim 1, wherein said grip portion includes at least two external ribs spaced from each other to facilitate handling.

4. A plastic container according to claim 3, wherein said ribs at least in part extend circumferentially around said grip area onto the adjacent relatively longer sidewall portions.

5. A plastic container according to claim 4, including a plurality of said ribs spaced from each other.

6. A plastic container according to claim 1, wherein said grip portion and shoulder portion are inwardly curved towards said opening.

7. A plastic container according to claim 6, wherein said second relatively shorter sidewall and shoulder portions include an inwardly curved, recessed pour area beneath said opening.

8. A plastic container according to claim 1, wherein the external grip portion includes a curved external grip portion and the recessed portion is located beneath the grip portion.

9. A plastic container according to claim 8, wherein the recessed portion is at least 0.500 inch below the neck finish portion.

10. A plastic container according to claim 9, wherein the grip area extends over a portion of said relatively longer sidewall portions.

11. A plastic container according to claim 10, wherein the grip area includes two of said recessed portions, one of which on each of the adjacent longer sidewall portions.

12. A plastic container according to claim 1, wherein the neck finish includes a flange portion for a snap-on closure.

13. A plastic container according to claim 1, wherein the ratio of the circumference of the opening to the base circumference is from 1:1.4 to 1:2.5.

* * * * *